United States Patent [19]

Kamin et al.

[11] Patent Number: 4,775,075

[45] Date of Patent: Oct. 4, 1988

[54] MONEY TILL HAVING PIVOTING AND SLIDING CLOSURE

[75] Inventors: Hartmut Kamin, Göttingen; Günter Baitz, Berlin, both of Fed. Rep. of Germany

[73] Assignee: Nixdorf Computer AG, Fed. Rep. of Germany

[21] Appl. No.: 71,779

[22] Filed: Jul. 10, 1987

[30] Foreign Application Priority Data

Aug. 6, 1986 [DE] Fed. Rep. of Germany ..... 3627120

[51] Int. Cl.[4] ..... B65D 43/14

[52] U.S. Cl. ..... 220/331; 220/345; 312/295

[58] Field of Search ..... 220/331, 345, 346; 312/295, 299, 304; 49/404, 371, 372, 373

[56] References Cited

U.S. PATENT DOCUMENTS 4,260,069 4/1981 Juergens ..... 220/331

4,496,050 1/1985 Kirchner et al. ..... 220/331

*Primary Examiner*—George T. Hall

[57] ABSTRACT

In a money till with a box-shaped housing (10), whose upper side is partially closed by a stationary cover (12) and partially closed by a lid (16), the lid includes two lid parts (18, 20) connected with one another about a pivot axis (22), the first lid part (18) which is closer to the stationary cover (12) being guided for sliding movement parallel to the stationary cover (12), whereas the second lid part (20) is connected with at least one guide element (34) which, at a radial spacing from the pivot axis (22), is engaged with a cam curve (36) so that upon a sliding of the lid (16) the second lid part (20) is pivoted between a closed position and an open position.

4 Claims, 2 Drawing Sheets

MONEY TILL HAVING PIVOTING AND SLIDING CLOSURE

Figure 1:
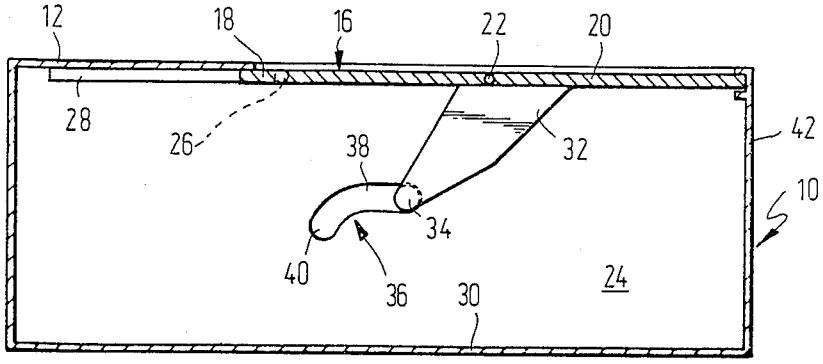

The invention relates to a money till with a box-shaped housing whose upper side is partly closed by a stationary cover and partly by a lid which lid in the area of its side edges is slidable on the side walls of the housing and which lid is pivotal about a pivot axis perpendicular to the housing side walls so that upon opening of the money till it is at least partially movable under the stationary cover.

Money tills are known wherein upon releasing a mechanism a money drawer moves out of the the till housing. This, of course, has accompanying technical and ergcnomic disadvantages since the permitted maximum outward movement of the drawer varies from country to country and, on the other hand, the operating person constantly has to move away from the drawer as it moves outwardly.

A money till is know from EP-Al 72 370 whose lid is swingable upwardly. In another embodiment from the same publication the lid is movable into the housing of the till. In both cases, however, upon opening of the lid the money drawer moves outwardly. This has, as a result, the above-described disadvantages.

The money till of the above-mentioned type is known from French Pat. No. 1 122 750 wherein in the opening of the forward area of the till the lid is movable in a combined pivoting and sliding movement under the stationary cover. Since in this case, however, only half of the money drawer is exposed the drawer has to be pulled by about half of it's length out of the till housing in order to allow full access to the money compartments.

The invention has as it's object the provision of a money till of the foregoing type which, on one hand, has a large access opening without, on the other hand, exibiting the above-described disadvantages of an outwardly movable drawer.

This object is solved in accordance with the invention, in that the lid includes two connected lid parts which are pivotally connected to one another about the pivot axis, the first lid part which is closer to the stationary cover being slidably guided on the housing side walls parallel to the stationary cover, whereas the second lid part is connected to at least one guide element which engages, in radial spacing from the pivot axis, a cam curve formed in a housing side wall so that upon a sliding of the lid the second lid part is pivoted between a closed position and an open position.

Through the construction of the lid in accordance with the invention the access opening in the housing can be made so large that in the arrangement an outwardly movable money drawer can be done away with. On the other hand, the swingable lid part is not so wide that upon the upward swinging of the lid, part of the view of a cash box arranged on the stationary cover of the till is not hindered.

In an embodiment of the inventive money till, which is constructively easy to realize, the guide element is formed by a stud which is associated with a bracket connected to the second lid part and which is engaged in a cam curve forming guide slot in the housing side wall. Therefore, the cam curve can be so formed that it includes a first section running parallel to the housing bottom and a second section, following the first section, which is bent toward the housing bottom, the spacing of the first section from the guide rail for the first cover part being smaller than the spacing of the guide element from the pivot axis. At the beginning of the opening movement of the lid, both lid parts partake of a horizontal sliding movement. At the point where the guide element moves into the bent second section of the guide slot, the second cover part is compelled to pivot so that it is lifted up when the first lid part is moved entirely under the stationary cover. For the opening and closing of the lid, the lid can in a known way be connected with a drive apparatus so that, for example, it is automatically opened upon the operation of an unlocking magnet.

Figure 2:
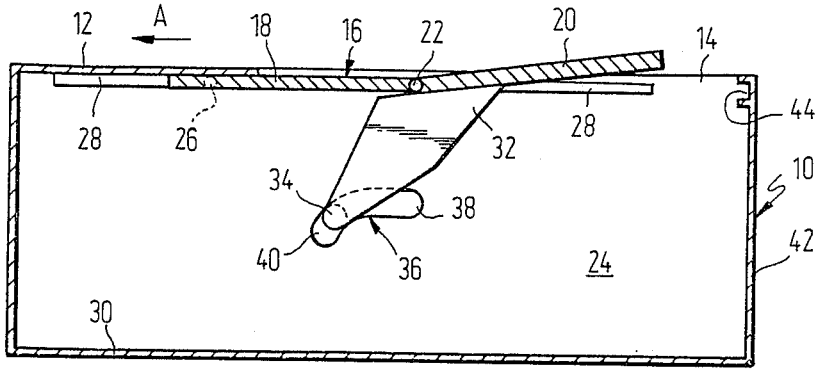
Figure 3:
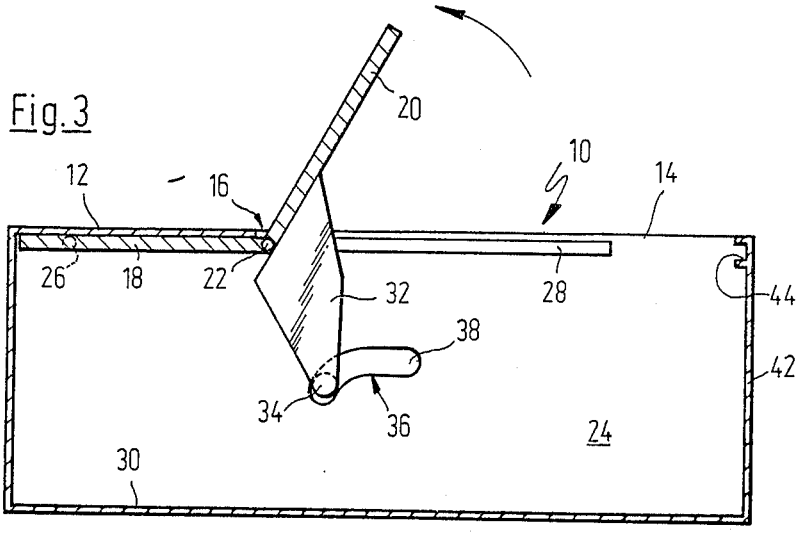

Further features and advantages of the invention will be apparent from the following description, which in connection with the accompanying drawings, explains the invention in connection with an exemplary embodiment. The drawings are:

FIGS. 1–3 are schematic, cross-sectional views taken perpendicular to the pivot axis of the lid parts of a money till according to the invention, the figures showing the lid parts in different positions of the lid.

In FIGS. 1–3, a box-shaped housing of a money till is indicated at 10, the housing on its upper side being closed by a stationary cover 12 extending about a third of the length of the till, while an access opening 14 which extends over about two thirds of the length of the housing upper side, is covered by a lid indicated generally at 16 (FIG. 1). The lid 16 consists of two plate-shaped lid parts 18 and 20 which are connected with one another by a hinge having a hinge axis 22. The first lid part 18, which is positioned closer to the cover 12, carries on each of its side edges which run parallel to the side walls 24 of the housing 10, a roller 26 which is guidably received in a guide rail 28 fixed to the associated side wall 24. In the same way non-illustrated rollers are arranged on the hinge axis 22 and are guidably received in the rail 28. In this way the first lid part 18 is slidable parallel to the stationary cover 12 from the closed position shown in FIG. 1 until it is practically entirely vanished under the stationary cover 12. (FIG. 3).

The second lid part 20 carries on each of its edges which are parallel to the side walls 24 of the housing 10 a shaped plate or bracket 22, directed toward the housing bottom 30, to which a stud 34 is fastened which extends towards the side wall 24. This stud is received in a guide slot 36 in the associated side wall 24 or in a correspondingly formed guide rail. This guide slot 36 has a first section 38 rurning parallel to the rail 28 and following this first section another section 40 which is bent toward the housing body 30. If now the cover 16 is pushed in the direction of the arrow A, out of the closed position shown in FIG. 1 in which the lid part 20 has its forward free edge engaged in a groove 44 formed in the forward side 42 of the housing, the second lid part 20 first moves horizontally so long as the stud 34 moves in the section 38 of the guide slot 36. If the lid 16 is moved beyond this point further in the direction of the arrow A, the stud 36 enters the downwardly inclined section 40 of the guide slot 36 and is impeded in its further movement in the direction of the arrow A. As a result, the lid part 20 is compelled to swing upwardly in the direction of the arrow B so that the money till is easily accessable. Upon pressing down the lid part 20 in the direction opposite to that of the arrow B, or upon a sliding of the stud 34 in the direction toward the forward wall 32 of the housing, the lid 16 is again moved to the closed position shown in FIG. 1.

In FIGS. 1–3 only one side wall of the money till is illustrated with its associated parts. Preferably a corresponding formed plate 32 and stud and slot guide 36, 34 is also provided on the other non-illustrated side of the money till.

The arrangement of the invention makes possible, without the provision of a pull-out type drawer, an easy access to the money compartments provided in the money till. Therefore, the money till can be constructed in a considerablly more simple manner than is the case of a money till in a unit where a drawer is movable outwardly.

We claim:

1. A money till with a box shaped housing whose upper side is partially closed by a stationary cover and partially closed by a lid, which lid in the area of its side edges is movable on the housing side walls and pivotal about an axis extending perpindicular to the side walls, and which lid upon opening of the till is movable at least partially under the stationary cover, characterized in that the lid (16) includes two lid parts (18, 20) pivotally connected with one another, the first lid part (18) which is located closer to the stationary cover (12) being guided for sliding movement on the housing side wall (24) parallel to the stationary cover (12), with the second lid part (20) being connected with at least one guide element (34) which at a radial spacing from the pivot axis (22) is engaged with a cam curve (36) in one housing side wall (24) so that upon a sliding of the lid (16) the second lid part (20) is pivoted between a closed position and an open position.

2. A money till according to claim 1 further characterized in that the guide element (34) is formed by a stud, which stud is associated with a bracket (32) connected with the second lid part (20) and which stud is engaged with the cam curve forming guide slot (36) in the housing side (24).

3. A money till according to claim 1 further characterized in that the cam curve (36) has a first section (38) extending parallel to the housing bottom (30) and following the first section a second section bent towards the housing bottom (30), the spacing of the first section (38) from the rail guide (28) for the first lid part (18) being smaller than the spacing of the guide element (34) from the pivot axis (22).

4. A money till according to claim 2 further characterized in that the cam curve (36) has a first section (38) extending parallel to the housing bottom (30) and following the first section a second section bent towards the housing bottom (30), the spacing of the first section (38) from the rail guide (28) for the first lid part (18) being smaller than the spacing of the guide element (34) from the pivot axis (22).

* * * * *